United States Patent [19]

Green et al.

[11] Patent Number: 4,512,489

[45] Date of Patent: Apr. 23, 1985

[54] NIPPLE HOLDER

[75] Inventors: Jacqueline M. Green, 2956 W. Villa Maria Dr., Phoenix, Ariz. 85023; Jody L. Numbers, Scottsdale, Ariz.

[73] Assignee: Jacqueline M. Green, Phoenix, Ariz.

[21] Appl. No.: 590,159

[22] Filed: Mar. 16, 1984

[51] Int. Cl.[3] ..... B65D 6/08; B65D 1/36; A47G 19/08; B08B 13/00

[52] U.S. Cl. ..... 220/19; 220/21; 220/83

[58] Field of Search ..... 220/19, 21, 22, 83; 206/557, 565; 211/41, 71

[56] References Cited

U.S. PATENT DOCUMENTS

| | | | |
|---|---|---|---|
| 2,741,392 | 4/1956 | Weiss . | |
| 3,050,073 | 8/1963 | McMillan | 220/19 |
| 3,665,943 | 5/1972 | Lampman | 220/19 |
| 3,935,958 | 2/1976 | Frangos . | |
| 3,960,290 | 6/1976 | Yake | 220/19 |
| 4,058,233 | 11/1977 | Frangos . | |
| 4,192,432 | 3/1980 | Jordan | 220/19 |
| 4,318,478 | 3/1982 | DeWinter | 220/19 |
| 4,339,051 | 7/1982 | Crawford | 220/19 |

*Primary Examiner*—George E. Lowrance
*Attorney, Agent, or Firm*—Cahill, Sutton & Thomas

[57] ABSTRACT

A foraminous basket-like device for holding baby bottle nipples to permit them to be washed in a household automatic dishwasher. U-shaped longitudinal and transverse members intersect in a generally flat, intermediate region forming one face of the device. Protruding inwardly of the device from this face are a plurality of sets of four protuberances spaced to loosely receive the heads of nipples. A foraminous closure provides the opposite face of the device and holds the nipples in place in the sets of protuberances. The closure is flat and serves as a base for the device when it is placed on the rack of a dishwasher. The device, with the exception of the separate closure, is molded of plastic material as an integral unit. The closure also is molded of plastic material.

7 Claims, 3 Drawing Figures

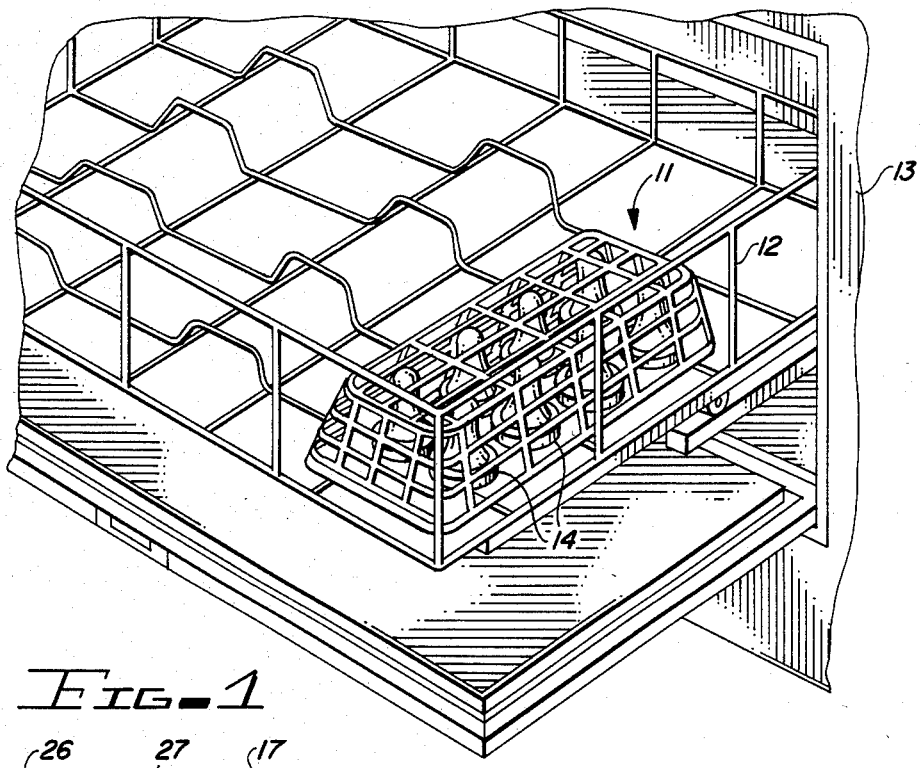
FIG. 1
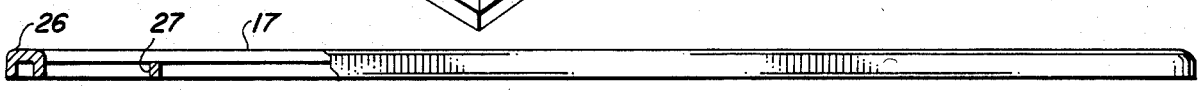
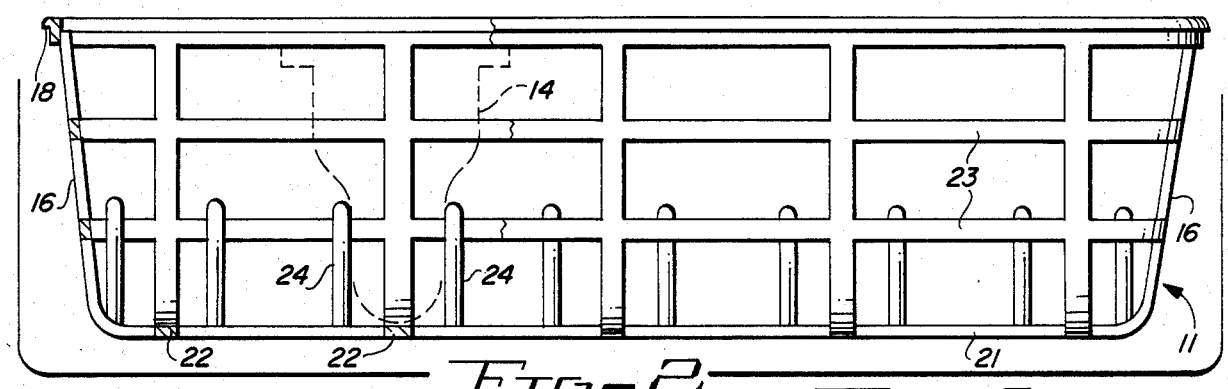
FIG. 2
FIG. 3
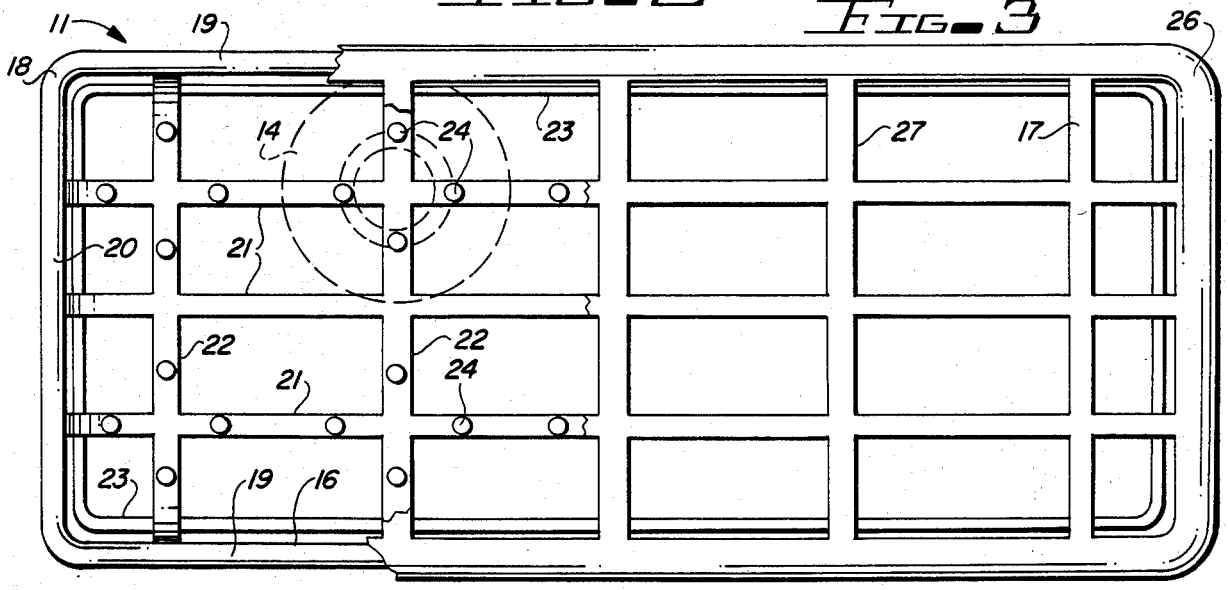

NIPPLE HOLDER

TECHNICAL FIELD

This invention is concerned with effective cleansing of baby bottle nipples. It contemplates the provision of a basket-like device for holding the nipples in position to be washed in a household automatic dishwasher.

BACKGROUND ART

It has been commonplace to provide compartmented baskets and racks for holding a plurality of articles, usually glassware, dinnerware or flatware, to be washed in violently agitating water in an automatic dishwasher. Examples of such devices can be found in the following United States patents:

U.S. Pat. No. 2,741,392 Weiss, granted Apr. 10, 1956 for "Glass-Washing Tray";

U.S. Pat. No. 3,935,958 Frangos, granted Feb. 3, 1976 for "Utensil Basket for Institutional Dishwashing Machines;" and U.S. Pat. No. 4,058,233 Frangos, granted Nov. 15, 1977 for "Utensil Basket for Institutional Dishwasing Machines". But the baskets and racks proposed for use with heavy; solid objects, such as food containers and utensils, are not particularly suited for holding light weight, highly flexible and crushable baby bottle nipples which are usually made of soft rubber or other rubber-like material. The cleansing environment within an automatic dishwasher is, on the other hand, particularly suited for nipples. Higher water temperatures than can be used comfortably with hand washing are used in the automatic dishwasher, and the violent, prolonged agitation of the wash and rinse waters can provide superior cleansing as well.

The principal problem to be solved has been that of providing some device for properly orienting the nipples in the dishwasher and confining the nipples sufficiently to prevent dislodgment of that orientation while allowing maximum access of the wash and rinse waters to all surfaces of the nipple to ensure cleaning. It is also deemed important that the device provided for this purpose be inexpensive, yet sufficiently durable to be used repeatedly and for an extended period of time.

DISCLOSURE OF INVENTION

This invention contemplates the provision of a basket-like holding device capable of retaining a plurality of baby bottle nipples in proper orientation to be effectively cleansed by the water being agitated in a household automatic dishwasher. Specifically, the nipples are oriented with the head of the nipple pointed upwardly and with the wide-open base portion pointed downwardly. The orientation is such as to ensure proper draining of cleansing water from the nipples. The nipples can be effectively cleaned in this orientation because all automatic dishwashers have power means for directing wash and rinse waters upwardly from the lower region of the dishwasher through the racks disposed above. The nipple holder of this invention is designed to rest on one of the racks in the dishwasher.

One face of the basket-like holder has a plurality of sets of protuberances projecting inwardly of the device for the purpose of receiving and loosely confining the heads of the nipples disposed within the device. A foraminous closure for the opposite face of the device is positioned to engage the bases of the nipples for the purpose of preventing the heads of the nipples from falling free of or being dislodged from between the sets of protuberances. The entire device is constructed to hold the nipples in the desired position and to prevent contact between adjoining nipples while at the same time providing absolute minimum contact between the holding device and the nipples themselves so that there is maximum exposure of the surface of the nipples to the cleansing waters.

The invention further contemplates that the basket-like portion of the holding device will be molded as a unit from plastic material by which a rugged, durable structure is achieved at relatively low cost. It is also contemplated that the foraminous cover will also be molded of plastic material.

BRIEF DESCRIPTION OF THE DRAWINGS

In the following detailed description reference is made to the accompanying drawings wherein:

FIG. 1 is a fragmentary perspective view of a household automatic dishwasher showing the nipple holding device of this invention in place of one of the racks of the dishwasher;

FIG. 2 is a side elevational view of the nipple holding device with portions thereof broken away; and FIG. 3 is a top plan view of the holding device, again with portions broken away.

BEST MODE FOR CARRYING OUT THE INVENTION

Referring particularly to FIG. 1, the nipple holding device of this invention is indicated generally by the reference numeral 11 and is shown resting on a pull-out rack 12 of a front-opening, household automatic dishwasher 13. Dishwasher 13 is normally equipped with some form of impeller (not shown) in the lower region of the dishwasher chamber for projecting wash and rinse water upwardly into contact with items placed on rack 12. The rack 12 is an open wire structure which readily allows cleansing liquid to pass therethrough.

The function of nipple holding device 11 is to position a plurality of baby bottle nipples 14 in upright position on dishwasher rack 12 and to maintain the orientation of the nipples as they are subjected to the violent agitation of the wash and rinse water within dishwasher 13.

Baby bottle nipples 14 are generally made from very soft rubber or rubber-like plastic materials and are easily distorted under the fluid forces present within the dishwasher. It is, therefore, required that the holding device 11 closely confine each of the nipples 14, but do so with minimum actual contact with the nipples so that the entire surface of each nipple is exposed to the cleansing action of the fluids within the dishwasher. The structure of holding device 11 which is capable of producing the desired holding action is illustrated in greater detail in FIGS. 2 and 3.

The nipple holding device is preferably manufactured in two pieces consisting of a basket 16 and a cover 17.

The basket 16 has a rim number 18 arranged generallyin a flat plane at one face of the basket 16. Rim number 18 consists of a pair of opposed side portions 19 and a pair of opposed end portions 20 (see FIG. 3). The basket 16 also comprises a plurality of spaced U-shaped longitudinally members 21 each of which has a generally flat intermediate region and upwardly and outwardly extending end regions which are connected to the end portions of rim number 18. The principal structure of the basket 16 is completed by a plurality of spaced, U-shaped, transverse members 22 which also have generally flat intermediate regions and outwardly and upwardly extending end regions connected to side portions 19 of rim number 18. If desired, the basket 16 may also be provided with one or more spaced reinforcing members 23 which encircle the basket and are joined to the upstanding regions of longitudinal members 21 and transverse members 22.

It will be noted that the generally flat intermediate regions of longitudinal members 21 and transverse members 22 intersect and form an open grid at one face of basket 16. At the intersections of longitudinal members 21 and transverse members 22 there are provided a plurality of sets, or clusters, of four protuberances 24. Protuberances 24 are spaced equal distances from the intersection of the longitudinal and transverse members on which they are positioned and the protuberances of each set are spaced from each other just sufficiently to permit the head of a baby bottle nipple to be placed therebetween. Each protuberance 24 is a dowel-like cylindrical member adapted to gently engage a small surface area only of a nipple 14. The sets of protuberances 24 are preferably spaced apart distances sufficient to preclude contact between adjoining nipples 14 when the nipples are in place with their heads disposed within the sets of protuberances.

The face of the basket 16 opposite the face carrying the protuberances 24 is closed by the foraminous cover 17 which has a rim 26 and an open grid 27 therein. Cover rim 26 preferably has a U-shaped cross section, as shown in FIG. 2, which is adapted to receive and frictionally engage rim member 18 of basket 16. Thus, when the rim 26 of cover 17 is forced over rim number 18 the cover 17 is frictionally retained in place closing one face of basket 16. Cover 17 is spaced from the intersecting regions of longitudinal members 21 and transverse members 22 a distance which is slightly in excess of the length, or height, of the nipples 14 so that when the cover 17 is in place on the basket 16 the cover holds the nipples in position with the heads of the nipples disposed between protuberances 24.

When the holding device 11 is to be loaded or unloaded it is positioned as shown in FIG. 2 with the open face of basket 16 disposed upwardly. When the device 11 has been filled with nipples to be washed and cover 17 is in place on basket 16 the device is inverted and placed on the dishwasher rack 12 as shown in FIG. 1 with the flat surface of cover 17 acting as a base on which the holding device rests during the time the nipples and device are in the dishwasher.

After the nipples have been cleaned in the dishwasher they are removed as a group within the holding device 11 and may, if desired, be stored therein in a sanitized condition until they are required to be used.

In accordance with this invention it is desired that the nipple holding device 11 be both economical and reliable. To this end it is proposed to manufacture the basket 16 as a unitary molded component, preferably made from polyethylene plastic material. Similarly, the cover 17 can be molded as a single piece from a similar material. Polyethylene plastic has the property of being able to withstand the temperature, moisture and chemical conditions present with a household dishwasher and has sufficient strength to withstand the forces to which it would be subjected in the dishwasher.

The outwardly directed disposition of the end regions of longitudinal members 21 and transverse members 22 permit a relatively simple, two part, mold to be employed to form the basket 16 with reinforcing members 23 in place thereon.

The construction of holding device 11 is such as to provide minimum contact between the device and the nipples 14 supported therein. It is desired that the spacing of the protuberances 24 and the relationship between the cover 17 and these protuberances be such that the nipples are permitted to move slightly within the holding device. Thus, the pulsating flow of fluid within the dishwasher causes some movement of the nipples 14 within the holding device 11 to ensure that at one time or another all surface areas of the nipples are free of any confining structure and therefore capable of being contacted by the wash and rinse waters. Also, the slight flexing of the nipples which undoubtedly occurs as they are subjected to the fluid forces within the dishwasher has the effect of flaking off any dried milk that mey have accumulated on the nipple during use. The overall construction and function of the holding device 11 is therefore such as to ensure a thorough, sanitary cleansing of the nipples in the dishwasher.

What is claimed is:

1. A device for holding a plurality of baby bottle nipples for washing comprising, a rim member having opposed side portions and opposed end portions arranged in a flat plane, a plurality of spaced U-shaped longitudinal members each having a generally flat intermediate region and upwardly extending end regions, the end regions of each of said longitudinal members being joined to said end portions of said rim members, a plurality of spaced U-shaped transverse members each having a generally flat intermediate region and upwardly extending end regions, the end regions of each of said transverse members being joined to said side portions of said rim member, the intermediate regions of said longitudinal members intersecting the intermediate regions of said transverse members to form a first foraminous face of said device spaced from the plane of said rim member, a plurality of sets of protuberances disposed on the intermediate regions of said longitudinal members and said transverse members, each of said sets comprising four equal-spaced protuberances surrounding an intersection between a transverse member and a longitudinal member, the space between the protuberances of each set being slightly in excess of the diameter of the head of a nipple and the spacing between nearby sets being greater than the diameter of the base of the nipple, whereby said sets of protuberances receive the heads of nipples and position the nipples out of contact with each other, and a foraminous closure engageable with the rim member of the device, said closure providing another face for the device, said other face being spaced from said first face a distance slightly in excess of the height of the nipples whereby when said closure engages said rim member said closure prevents the heads of the nipples from being withdrawn from between said protuberances.

2. The device of claim 1 further chracterized in that said rim member, said longitudinal and transverse members and said protuberances are molded as an integral unit.

3. The device of claim 1 further characterized in that there is provided at least one reinforcing member encircling and attached to each of the upwardly extending end portions of said longitudinal and said transverse members.

4. The device of claim 1 further characterized in that the end regions of said longitudinal members and said transverse members extend both upwardly and outwardly of the device.

5. The device of claim 4 further characterized in that said rim member, said longitudinal and transverse members said protuberances and said reinforcing member are molded as an integral unit.

6. The device of claim 1 further characterized in that said closure is provided with means for releasably gripping said rim member for holding said closure on said rim member.

7. The device of claim 1 further characterized in that said closure presents a generally flat surface on which said device can rest.

* * * * *